US005828394A

United States Patent [19]

Khuri-Yakub et al.

[11] Patent Number: 5,828,394

[45] Date of Patent: Oct. 27, 1998

[54] FLUID DROP EJECTOR AND METHOD

[75] Inventors: Butrus Thomas Khuri-Yakub, Palo Alto, Calif.; Laurent Levin, Paris, France

[73] Assignee: The Board of Trustees of the Leland Stanford Junior University, Stanford, Calif.

[21] Appl. No.: 530,919

[22] Filed: Sep. 20, 1995

[51] Int. Cl.[6] ..... B41J 2/45

[52] U.S. Cl. ..... 347/72; 347/55; 347/68; 310/328

[58] Field of Search ..... 347/54, 55, 68–72, 347/46; 310/328, 359; 239/102.1, 102.2

[56] References Cited

U.S. PATENT DOCUMENTS

| | | | |
|---|---|---|---|
| 4,533,082 | 8/1985 | Maehara et al. | 239/102.2 |
| 4,605,167 | 8/1986 | Maehara | 239/102.2 |
| 4,702,418 | 10/1987 | Carter et al. | 239/102.1 |
| 5,487,378 | 1/1996 | Robertson et al. | 128/200.16 |

FOREIGN PATENT DOCUMENTS

| | | | |
|---|---|---|---|
| 0077636A | 4/1983 | European Pat. Off. | B05B 5/00 |
| 0542723A | 5/1993 | European Pat. Off. | B05B 17/06 |
| 59-073963 | 4/1984 | Japan | B41J 3/04 |
| 60-068071 | 4/1985 | Japan | B05B 17/06 |
| 62-030048 | 2/1987 | Japan | B41J 3/04 |
| WO92/11050A | 7/1992 | WIPO | A61M 15/00 |
| WO93/01404A | 1/1993 | WIPO | G01D 15/18 |
| WO93/10910A | 6/1993 | WIPO | B05B 17/06 |

*Primary Examiner*—Peter S. Wong
*Assistant Examiner*—Gregory J. Toatley, Jr.
*Attorney, Agent, or Firm*—Flehr Hohbach Test Albritton & Herbert LLP

[57] ABSTRACT

An improved fluid drop ejector is disclosed which includes one wall including a thin elastic membrane having an orifice defining a nozzle and elements responsive to electrical signals for deflecting the membrane to eject drops of fluid from the nozzle.

10 Claims, 10 Drawing Sheets

FLUID DROP EJECTOR AND METHOD

BRIEF SUMMARY OF THE INVENTION

This invention relates generally to fluid drop ejectors and method of operation, and more particularly to fluid drop ejectors wherein the drop size, number of drops, speed of ejected drops, and ejection rate are controllable.

BACKGROUND OF THE INVENTION

Fluid drop ejectors have been developed for inkjet printing. Nozzles which allow the formation and control of small ink droplets permit high resolution, resulting in printing sharper characters and improved tonal resolution. Drop-on-demand inkjet printing heads are generally used for high-resolution printers.

In general, drop-on-demand technology uses some type of pulse generator to form and eject drops. In one example, a chamber having an ink nozzle is fitted with a piezoelectric wall which is deformed when a voltage is applied. As a result, the fluid is forced out of the nozzle orifice and impinges directly on an associated printing surface. Another type of printer uses bubbles formed by heat pulses to force fluid out of the nozzle. The drops are separated from the ink supply when the bubbles collapse.

There is a need for an improved fluid drop ejector for use not only in printing, but also, for photoresist deposition in the semiconductor and flat panel display industries, drug and biological sample delivery, delivery of multiple chemicals for chemical reactions, DNA sequences, and delivery of drugs and biological materials for interaction studies and assaying, and a need for depositing thin and narrow layers of plastics for use as permanent and removable gaskets in micro-machines. There is also need for a fluid ejector that can cover large areas with little or no mechanical scanning.

OBJECTS AND SUMMARY OF THE INVENTION

It is an object of this invention to provide an improved fluid drop ejector.

It is another object of the invention to provide a fluid drop ejector in which the ejected fluid, drop size, drop velocity, ejection rate and number of drops can be easily controlled.

It is a further object of the invention to provide a fluid drop ejector which can be micro-machined.

It is another object of the invention to provide a fluid drop ejector which can be micro-machined to provide a selectively excitable matrix of membranes having nozzles for ejection of fluid drops.

It is a further object of the invention to provide a fluid drop ejector in which a membrane including a nozzle is actuated to eject droplets of fluid, at or away from the mechanical resonance of the membrane.

The foregoing and other objects are achieved by a fluid drop ejector which includes a fluid reservoir with one wall comprising a thin, elastic membrane having an orifice defining a nozzle. The membrane is adapted to mechanically vibrate on application of bending forces applied preferentially at its resonant frequency. When said reservoir contains fluid, the membrane deflects to form and eject drops at the nozzle. The reservoir is not necessarily full of fluid.

BRIEF DESCRIPTION OF THE DRAWINGS

The foregoing and other objects of the invention will be more fully understood from the following description read in connection with the accompanying drawings, wherein.

DESCRIPTION OF THE PREFERRED EMBODIMENTS

Figure 1:
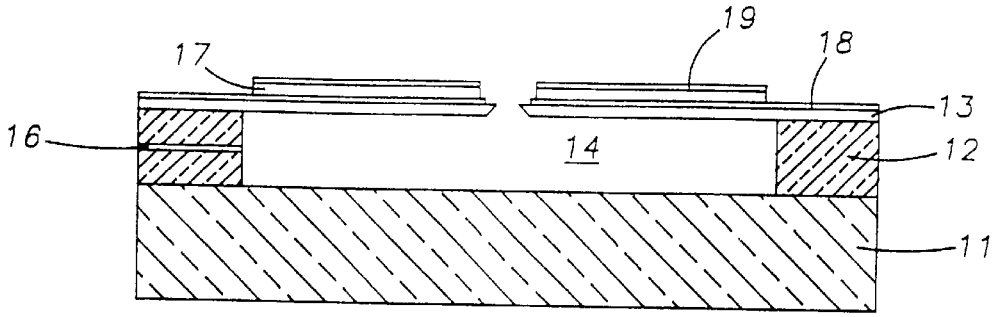
FIG. 1 is a sectional view of a drop-on-demand fluid drop ejector in accordance with the invention including a piezoelectrically driven membrane.
Figure 2:
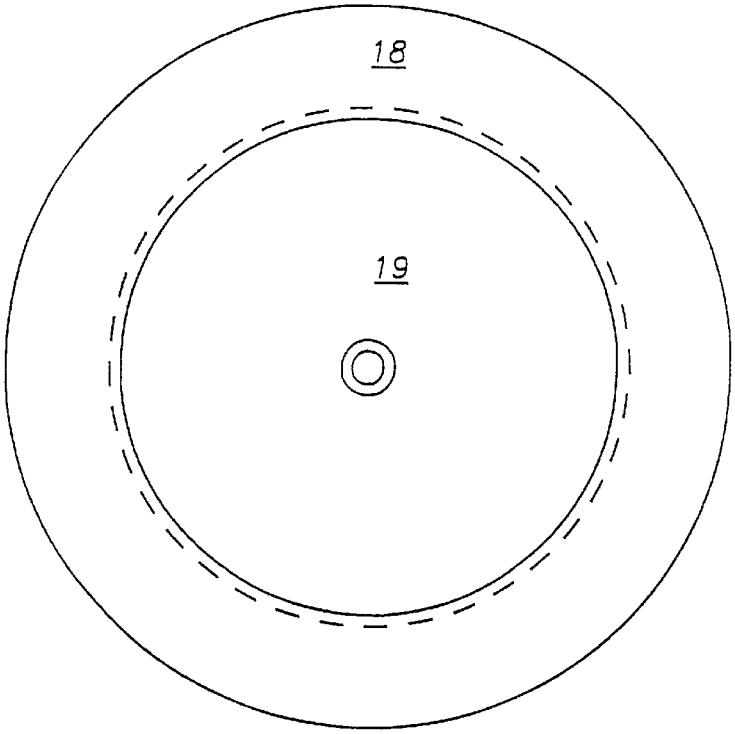
FIG. 2 is a top plan view of the ejector shown in FIG. 1.

A fluid drop ejector according to one embodiment of this invention is shown in FIGS. 1 and 2. The ejector includes a support body or substrate 11 which can have apertures for the supply of fluid. A cylindrical wall 12 supports an elastic membrane 13. The support 11, wall 12 and membrane 13 define a fluid reservoir 14. An aperture 16 may be formed in the wall 12 to permit continuous supply of fluid into the reservoir to replenish fluid which is ejected, as will be presently described. The supply opening could be formed in the support body or substrate 11 or its apertures. A piezoelectric annular disk 17 is attached to or formed on the upper surface of the membrane 13. The disk 17 includes conductive contact films 18 and 19. The piezoelectric film can also be formed on the bottom surface of the membrane, or can itself be the membrane.

Figure 4A:
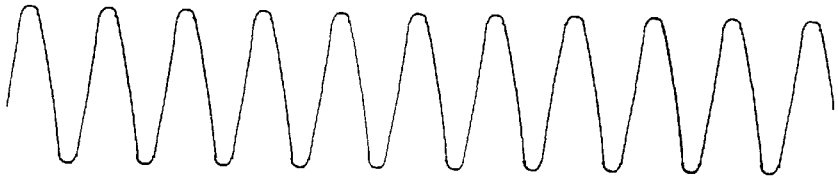
FIGS. 4A–4C show the ac voltage applied to the piezoelectric transducer of FIGS. 1 and 2, the mechanical oscillation of the membrane, and continuous ejection of fluid drops.
Figure 4B:
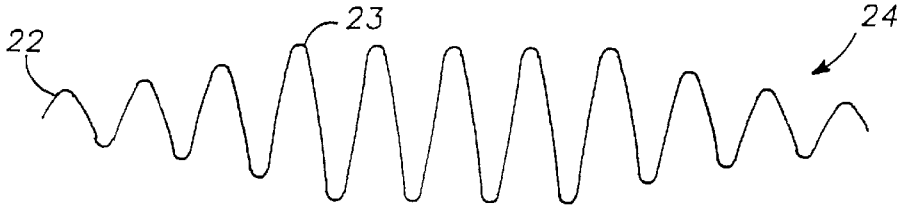
Figure 4C:
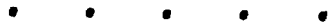
Figure 5A:
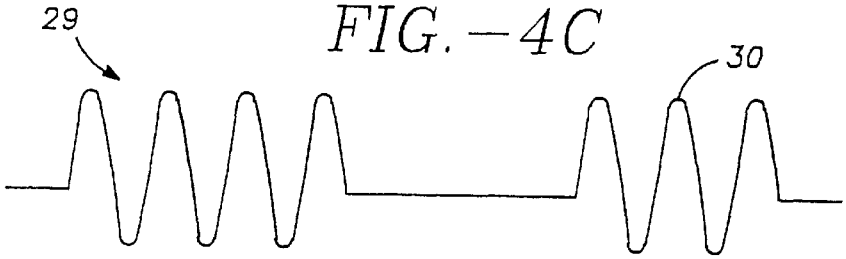
FIGS. 5A–5C show the application of ac voltage pulses to the piezoelectric transducer of FIGS. 1 and 2, the mechanical oscillation of the membrane and the drop-on-demand ejection of drops.
Figure 5B:
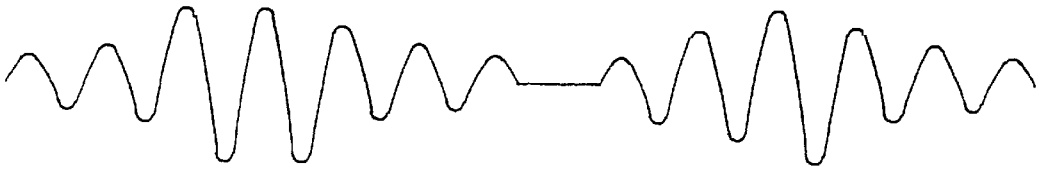
Figure 5C:
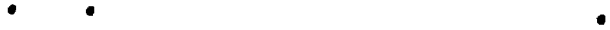
Figure 6A:
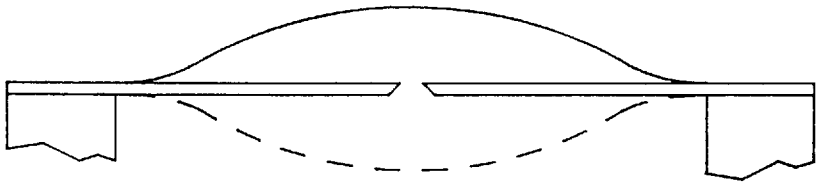
FIGS. 6A–6C show the first three mechanical resonant modes of a membrane as examples among all the modes of superior order in accordance with the invention.
Figure 6B:
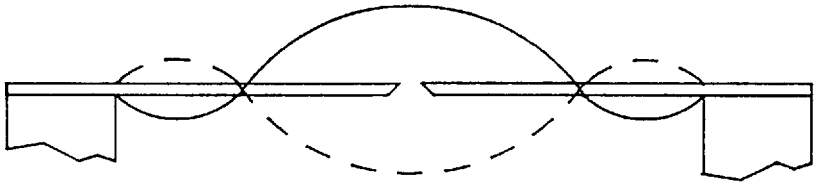
Figure 6C:
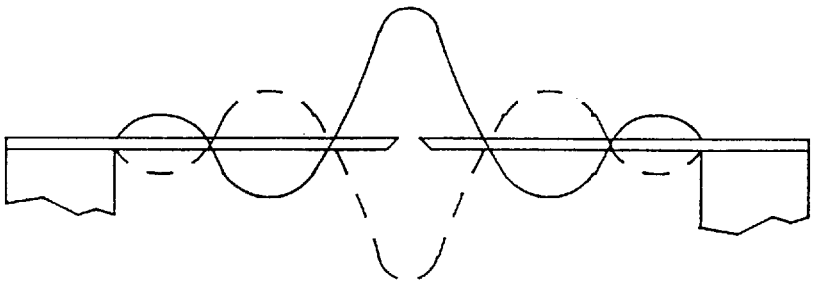

In accordance with the invention, the membrane is driven so that it mechanically oscillates preferably into resonance. This is illustrated in FIGS. 4 through 6. FIG. 4A shows a sine wave excitation voltage which is applied to the piezoelectric transducer. The transducer applies forces to the membrane responsive to the applied voltage. FIG. 4B shows the amplitude of deflection at the center of the membrane responsive to the applied forces. It is noted that when the power is first applied, the membrane is only slightly deflected by the first power cycle, as shown at 22, FIG. 4B. The deflection increases, whereby, in the present example, at the third cycle, the membrane is in maximum deflection, as shown at 23, FIG. 4B. At this point, its deflection cyclically continues at maximum deflection with the application of each cycle of the applied voltage, and permits the ejection of each corresponding drop, as shown in FIG. 4C. When the power is turned off, the membrane deflection decays as shown at 24, FIG. 4B. The frequency at which the membrane resonates is dependent on the membrane material, its elasticity, thickness, shape and size. The shape of the membrane is preferentially circular; however, the other shapes, such as square, rectangular, etc., can be made to resonate and eject fluid drops. In particular, an elliptic membrane can eject two drops from its focal points at resonance. The amount of deflection depends on the magnitude of the applied power. FIG. 6 shows, for a circular membrane, that the membrane may have different modes of resonant deflection. FIG. 6A shows deflection at its fundamental frequency; FIG. 6B at the first harmonic and FIG. 6C at the second harmonic.

Figure 7A:
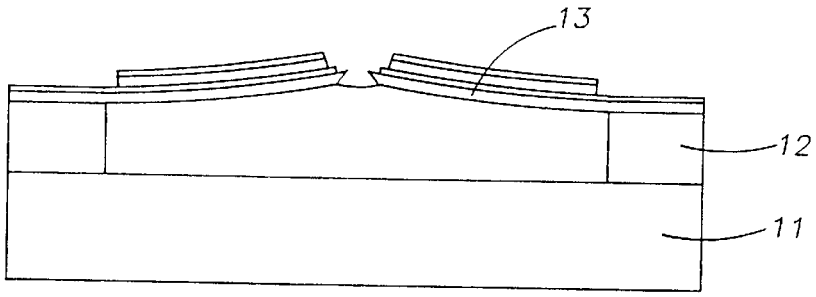
FIGS. 7A–7D show the deflection of the membrane responsive to the application of an excitation ac voltage.
Figure 7B:
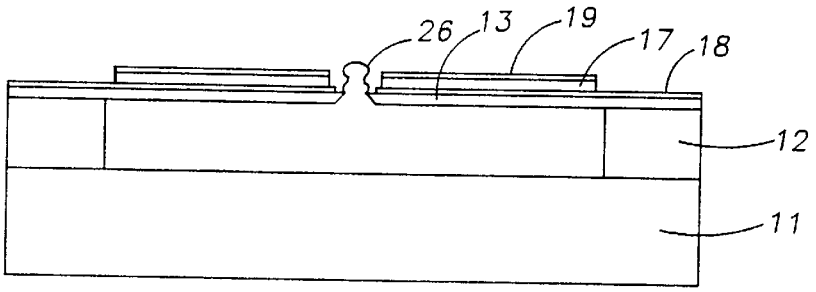
Figure 7C:
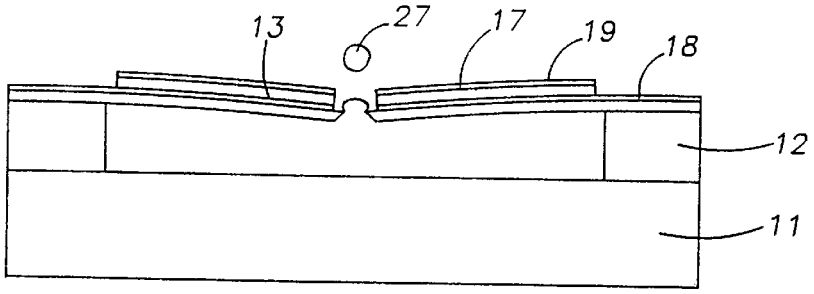
Figure 7D:
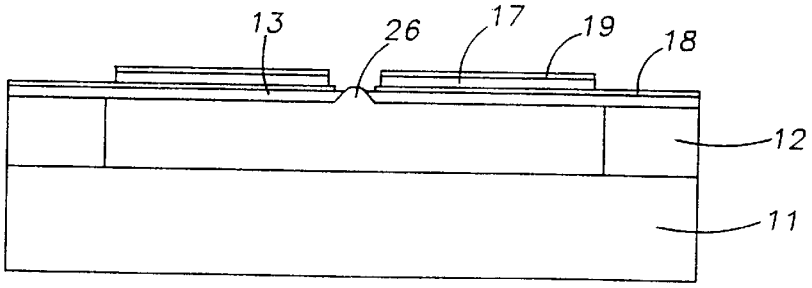

The action of the membrane to eject drops of fluid is illustrated in FIGS. 7A–7D. These figures represent the deflection at the fundamental resonance frequency. FIG. 7A shows the membrane deflected out of the reservoir, with the liquid in contact with the membrane. FIG. 7B shows the membrane returning to its undeflected position, and forming an elongated bulb of fluid 26 at the orifice nozzle. FIG. 7C shows the membrane extending into the reservoir and achieving sufficient velocity for the bulb to cause it to break away from the body of fluid 26 and form a drop 27 which travels in a straight line away from the membrane and nozzle toward an associated surface such as a printing surface. FIG. 7D represents the end of the cycle and the shape of the fluid bulb at that point.

Referring to FIG. 4C, it is seen that the membrane reaches maximum deflection upon application of the third cycle of the applied voltage. It then ejects drops with each cycle of the applied voltage as long as the applied voltage continues. FIGS. 5A–5C show the application of excitation pulses. At 29, FIG. 5A, a four-cycle pulse is shown applied, causing maximum deflection and ejection of two single drops. The oscillation then decays and no additional drops are ejected. At 30, three cycles of power are applied, ejecting one drop. It is apparent that drops can be produced on demand. The drop rate is equal to the frequency of the applied excitation voltage. The drop size is dependent on the size of the orifice and the magnitude of the applied voltage. The fluid is preferably fed into the reservoir at constant pressure to maintain the meniscus of the fluid at the orifice in a constant concave, flat, or convex shape, as desired. The fluid must not contain any air bubbles, since it would interfere with operation of the ejector.

Figure 3:
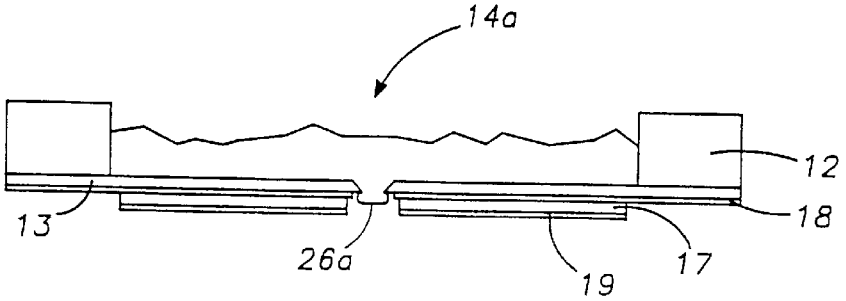
FIG. 3 is a sectional view of a drop-on-demand fluid drop ejector in accordance with another embodiment of the invention.

FIG. 3 shows a fluid drop ejector which has an open reservoir 14*a*. The weight of the fluid keeps it in contact with the membrane. The bulb 26*a* is ejected due to the suppression caused by deflection of the membrane 13 into the fluid.

A fluid drop ejector of the type shown in FIG. 3 was constructed and tested. More particularly, the resonant membrane comprised a circular membrane of steel (0.05 mm in thickness; 25 mm in diameter, having a central hole of 150 μm in diameter). This membrane was supported by a housing composed of a brass cylinder with an outside diameter of 25 mm and an inside diameter of 22.5 mm. The membrane was actuated by an annular piezoelectric plate bonded on its bottom and on axis to the circular membrane. The annular piezoelectric plate had an outside diameter of 23.5 mm and an inside diameter of 18.8 mm. Its thickness was 0.5 mm. The reservoir was formed by the walls of the housing and the top was left open to permit refilling with fluid. The device so constructed ejected drops of approximately 150 μm in diameter. The ejection occurred when applying an alternative voltage of 15 V peak to the piezoelectric plate at a frequency of 15.5 KHz (with 0.3 KHz tolerance of bandwidth), which corresponded to the resonant frequency of the liquid loaded membrane. This provided a bending motion of the membrane with large displacements at the center. Thousands of identical drops were ejected in one second with the same direction and velocity. The level of liquid varied from 1–5 mm with continuous ejection while applying a slight change in frequency to adapt to the change in the resonant frequency of the composite membrane due to different liquid loading. When the level of liquid remained constant, the frequency of drop formation remained relatively constant. The excitation was sinusoidal, although square waves and triangular waveforms were used as harmonic signals and also gave continuous drop ejection as the piezoelectric material was excited.

As will be presently described, the fluid drop ejector can be implemented using micro-machining technologies of semiconductor materials. The housing could be silicon and silicon oxide, the membrane could be silicon nitride, and the piezoelectric could be a deposited thin film such as zinc oxide. In this manner, the dimensions of an ejector could be no more than 100 microns and the orifice could be anywhere from a few to tens of microns. Two-dimensional matrices can be easily implemented for printing at high speed with little or no relative motion between the fluid drop ejector and object upon which the fluid is to be deposited.

The membrane can be excited into resonance with other types of drivers. For example, FIG. 7 shows an ejector in which the membrane is electrostatically vibrated. The membrane 31 may be of silicon nitride with a conductive film 32. The membrane is spaced from the substrate 33 by an insulating oxide ring 34; a conductive film 36 is applied to the lower surface of the substrate. Thus, when voltage is applied between the two conductive films, it induces a force proportional to the square of the electric field between the two conductive films 32, 36. The added simplicity of not needing a piezoelectric transducer is quite important; however, such a design will only work for fluids that are non-conductive. Micro-machining such a device will be described below.

Figure 8:
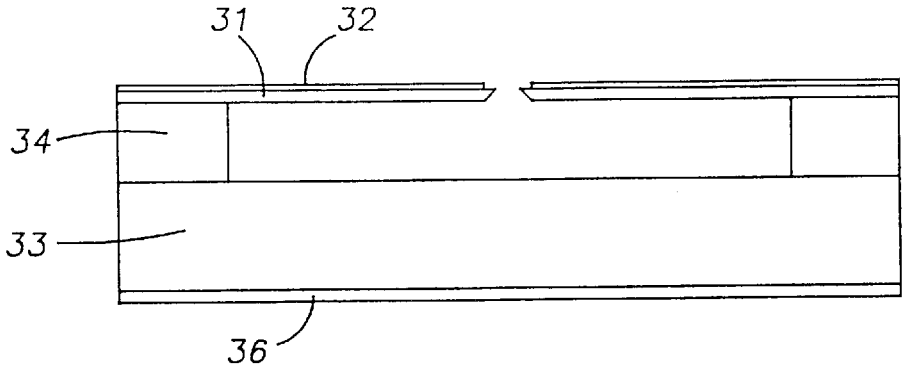
FIG. 8 is a side elevational view of a fluid drop ejector wherein the membrane is electrostatically oscillated.
Figure 9:
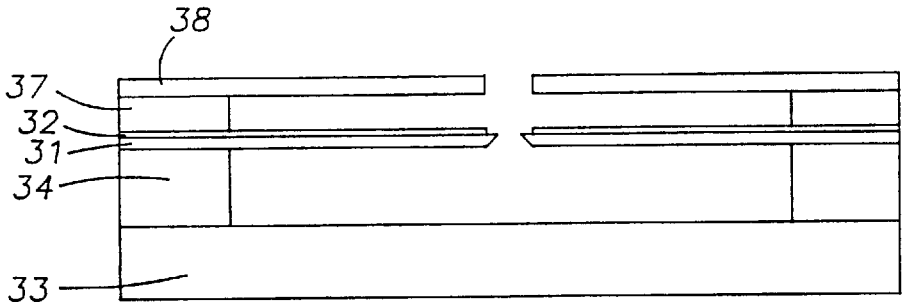
FIG. 9 shows another embodiment of an electrostatically oscillated membrane.

FIG. 9 shows an electrostatic fluid drop ejector which can be used to eject conductive fluids. The same reference numbers have been applied to parts corresponding to FIG. 8. The fluid drop ejector of FIG. 9 includes an insulating support 37 which supports a rigid conductive member 38 spaced from the film 32. Voltage applied between the conductive member 37 and conductive film 32 will give rise to forces proportional to the square of the electric field therebetween. These forces will serve to deflect the membrane 31.

Figure 10:
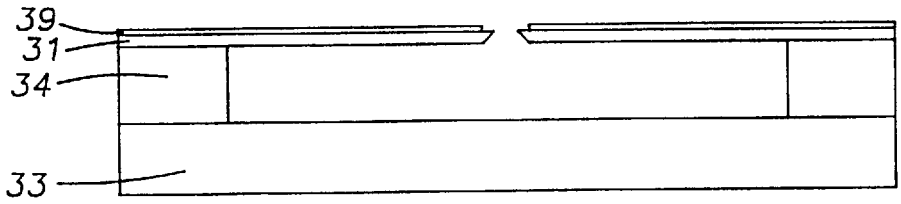
FIG. 10 shows a fluid drop ejector in which the membrane is oscillated by a magnetic driver.

FIG. 10 illustrates a device similar to that of FIGS. 8 and 9, where like reference numbers have been applied to like parts. However, the transducer 39 is a magnetic transducer electrically driven to deflect and bring into resonance the membrane 31. This transducer can also be driven magnetically or electrically by another transducer placed at a distance such as behind a piece of paper.

Figure 11A:
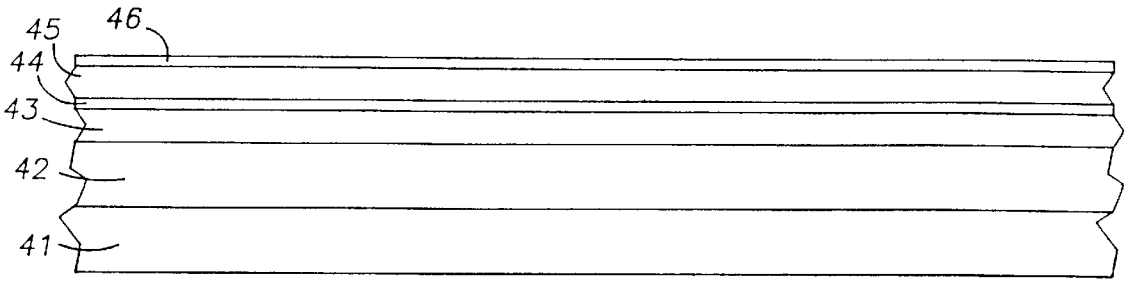
FIGS. 11A–11D show the steps in the fabrication of a matrix of fluid drop ejectors of the type shown in FIGS. 1 and 2.
Figure 11B:
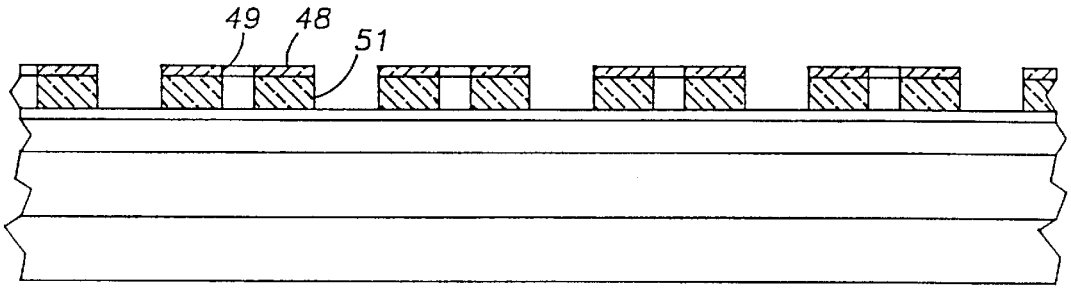
Figure 11C:
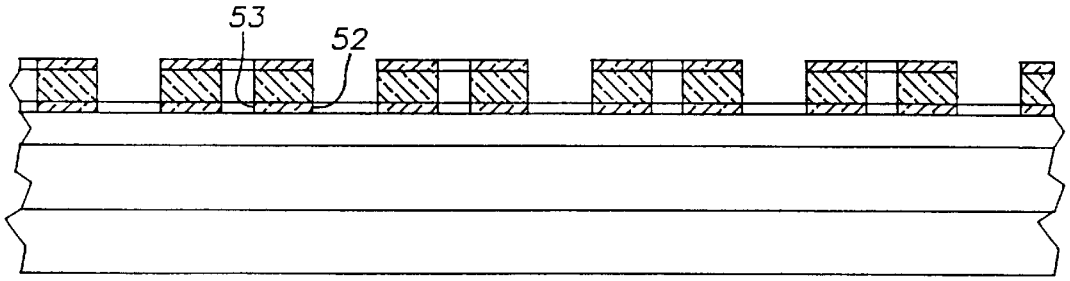
Figure 11D:
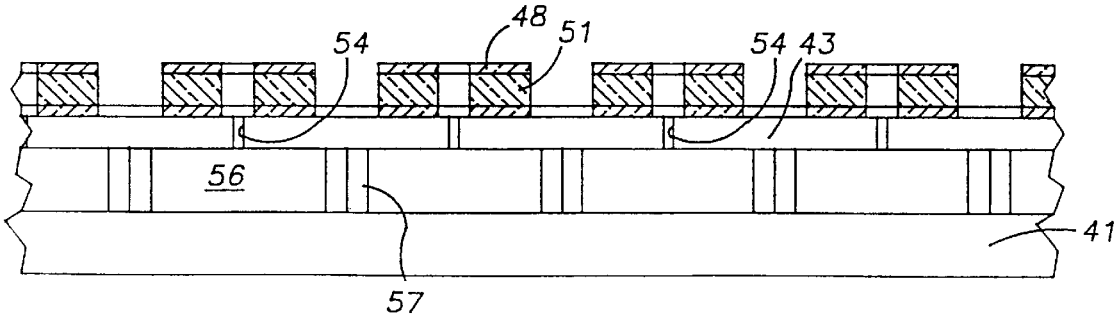

Referring to FIGS. 11A–11D, the steps of forming a micro-machined matrix of fluid drop ejectors of the type shown in FIGS. 1 and 2 from semiconductor material are shown. By well-known semiconductor film or layer-growing techniques, a silicon substrate 41 is provided with successive layers of silicon oxide 42, silicon nitride 43, metal 44, piezoelectric material 45 and metal 46. The next steps, shown in FIG. 11B, are to mask and etch the metal film 46 to form disk-shaped contacts 48 having a central aperture 49 and interconnected along a line. The next step is to etch the piezoelectric layer in the same pattern to form transducers 51. The next step is to mask and etch the film 44 to form disk-shaped contacts 52 having central apertures 53 and interconnected along columns 55, FIG. 12. The next steps, FIG. 11D, are to mask and etch orifices 54 in the silicon nitride layer 43. This is followed by selectively etching the silicon oxide layer 42 through the orifices 54 to form a fluid reservoir 56. The silicon nitride membrane is supported by silicon oxide posts 57.

Figure 12:
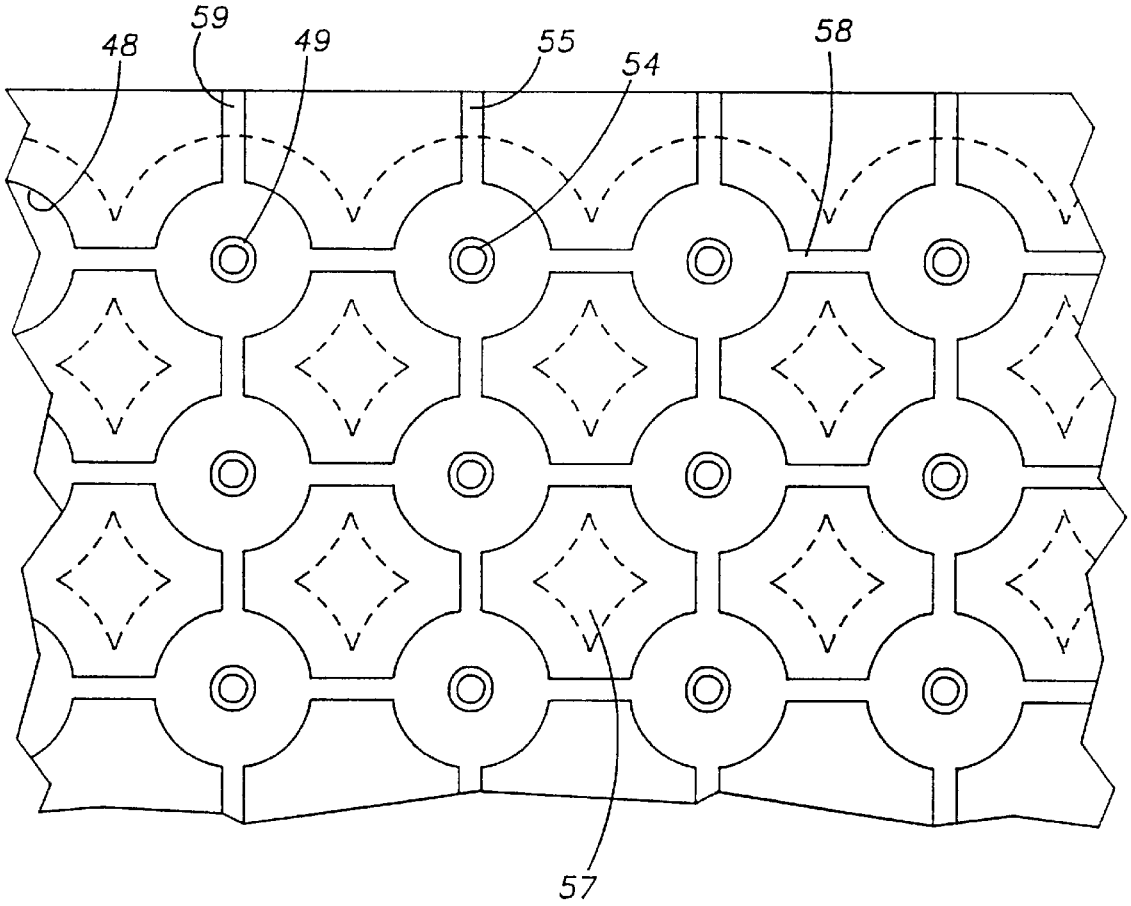
FIG. 12 is a top plan view of a matrix fluid drop ejector formed in accordance with the process of FIGS. 11A–11D.

FIG. 12 is a top plan view of the matrix shown in FIGS. 11A–11D. The dotted outline shows the extent of the fluid reservoir. It is seen that the membrane is supported by the spaced posts 57. The lower contacts of the piezoelectric members in the horizontal rows are interconnected as shown and the upper contacts of the piezoelectric members in the columns are interconnected as shown, thereby giving a matrix in which the individual ejectors can be excited, thereby ejecting selected patterns of drops. By micromachining, closely spaced patterns of orifices or nozzles can be achieved. If the spacing between orifices is 100 $\mu$m, the matrix will be capable of simultaneously depositing a resolution of 254 dots per inch. If the spacing between orifices is 50 $\mu$m, the matrix will be capable of simultaneously depositing a resolution of 508 dots per inch. Such resolution would be sufficient to permit the printing of lines or pages of text without the necessity of relative movement between the print head and the printing surface.

Figure 13A:
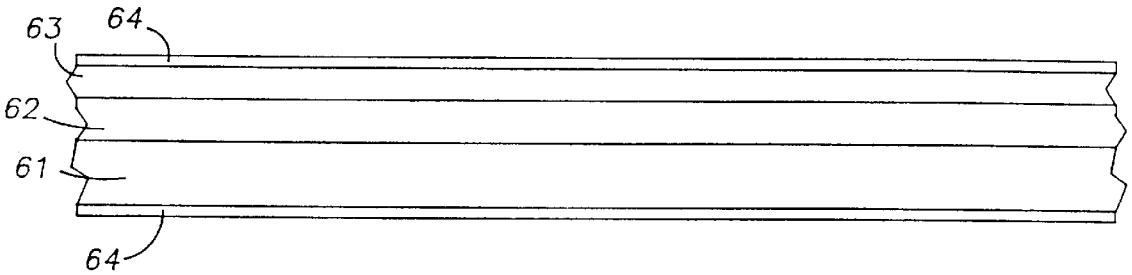
FIGS. 13A–13C show the steps in the fabrication of a matrix of electrostatic fluid drop ejectors.
Figure 13B:
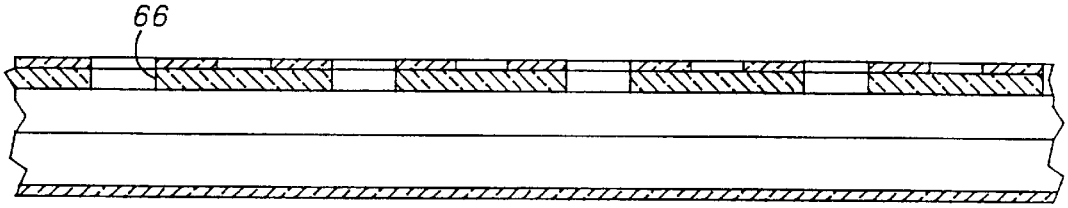
Figure 13C:
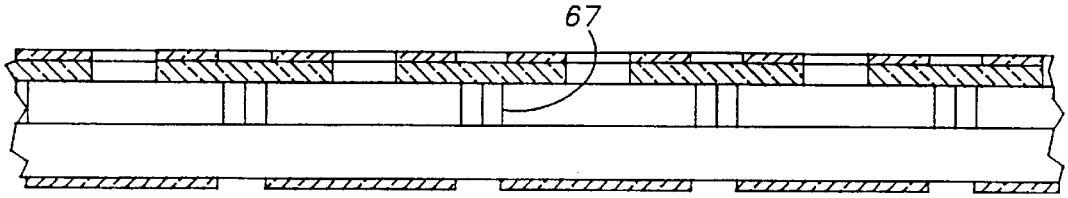
Figure 14:
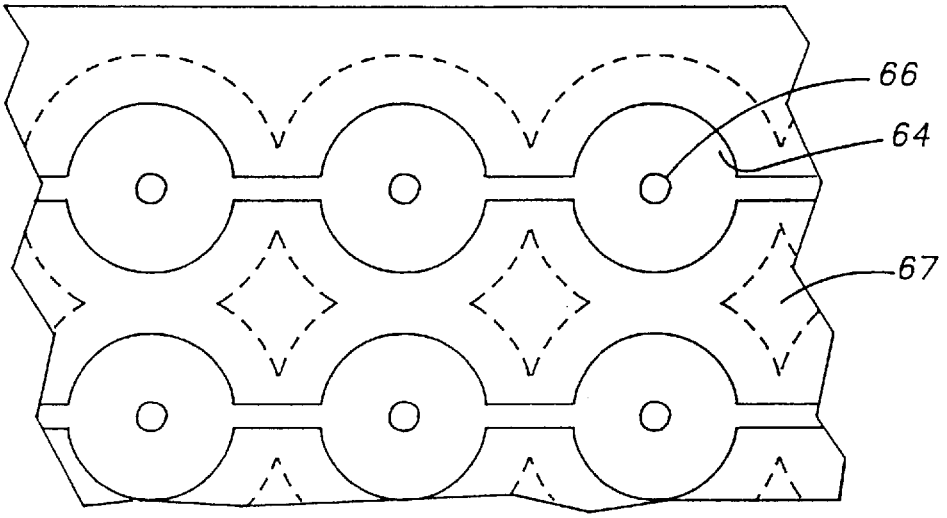
FIG. 14 is a top plan view of the fluid drop ejector shown in FIG. 12.
Figure 15:
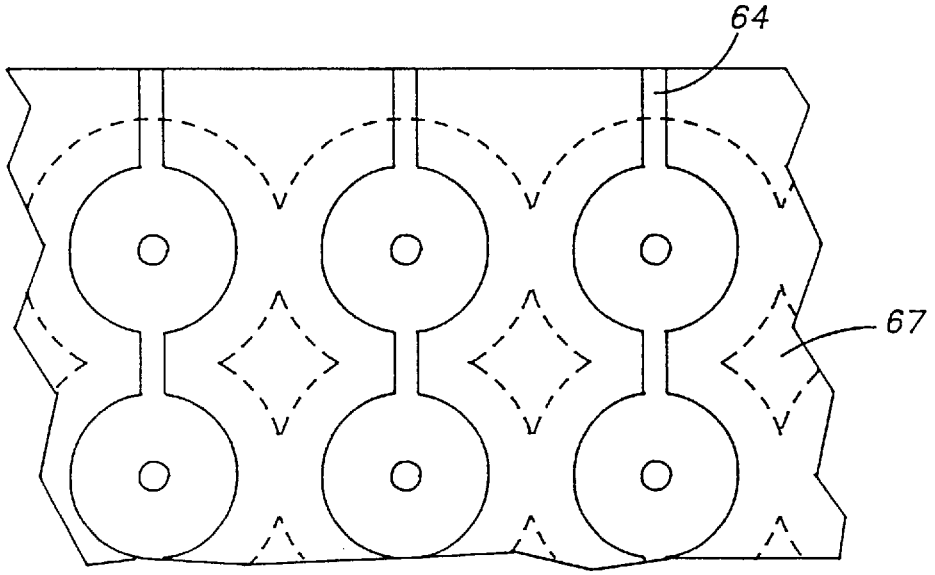
FIG. 15 is a bottom plan view of the fluid drop ejector shown in FIG. 12.

The steps of forming a matrix, including electrostatic excited fluid drop ejectors of the type shown in FIG. 9, are illustrated in FIGS. 13A–13C. The first step is to start with the highly doped polysilicon wafer 61 which serves as the substrate. The next steps are to grow a thick layer (1–10 $\mu$m) of oxide 62 thermally or by chemical vapor deposition or any other IC processing method, followed by the deposition of a 7500 Å-thick layer of low-stress LPCVD silicon nitride 63. The back side of the wafer is stripped of these layers and a 500 Å film of gold 64 is evaporated on both sides of the wafer. The resulting structure is shown in FIG. 13A. A resist pattern of 2 $\mu$m diameter dots on a two-dimensional grid with 100 $\mu$m period is transferred lithographically to the wafer. The gold and nitride are etched through the dots by using a suitable chemical etch for the gold and a plasma etch for the nitride. The resulting structure is shown in FIG. 13B. The holes 66 provide access to silicon dioxide which acts as a sacrificial layer. The sacrificial layer is etched away by pure hydrofluoric acid during a timed etch. This leaves a portion 67 of the thermal oxide layer supporting the silicon nitride membrane. The size of the unsupported silicon nitride membrane is controlled by the etch time. However, if processing were terminated at this point, the surface tension between the liquid etchant and the silicon nitride layer would pull the nitride membrane down as the etchant is removed. Once the nitride and silicon are in contact, Vander Wals forces would hold the membrane to the silicon substrate and the device would no longer function. Two different techniques can be employed to prevent this from occurring. First, chemically roughening the silicon surface to reduce the surface area to which the membrane is exposed and thus, reduce the Vander Wals forces holding the membrane. The preferred chemical etchant is potassium hydroxide and is an anisotropic silicon etchant. After 20 minutes of etching, pyramidal posts are left on the silicon surface. The second step used for preventing sticking is to freeze-dry the structure; this results in the liquid etch sublimating instead of evaporating. The patterned upper metal film is interconnected along rows as shown in FIG. 14 and the bottom film is patterned and interconnected in columns as shown in FIG. 15. This provides a means for individually addressing the individual fluid drop ejectors to electrostatically eject a dot pattern.

Figure 16:
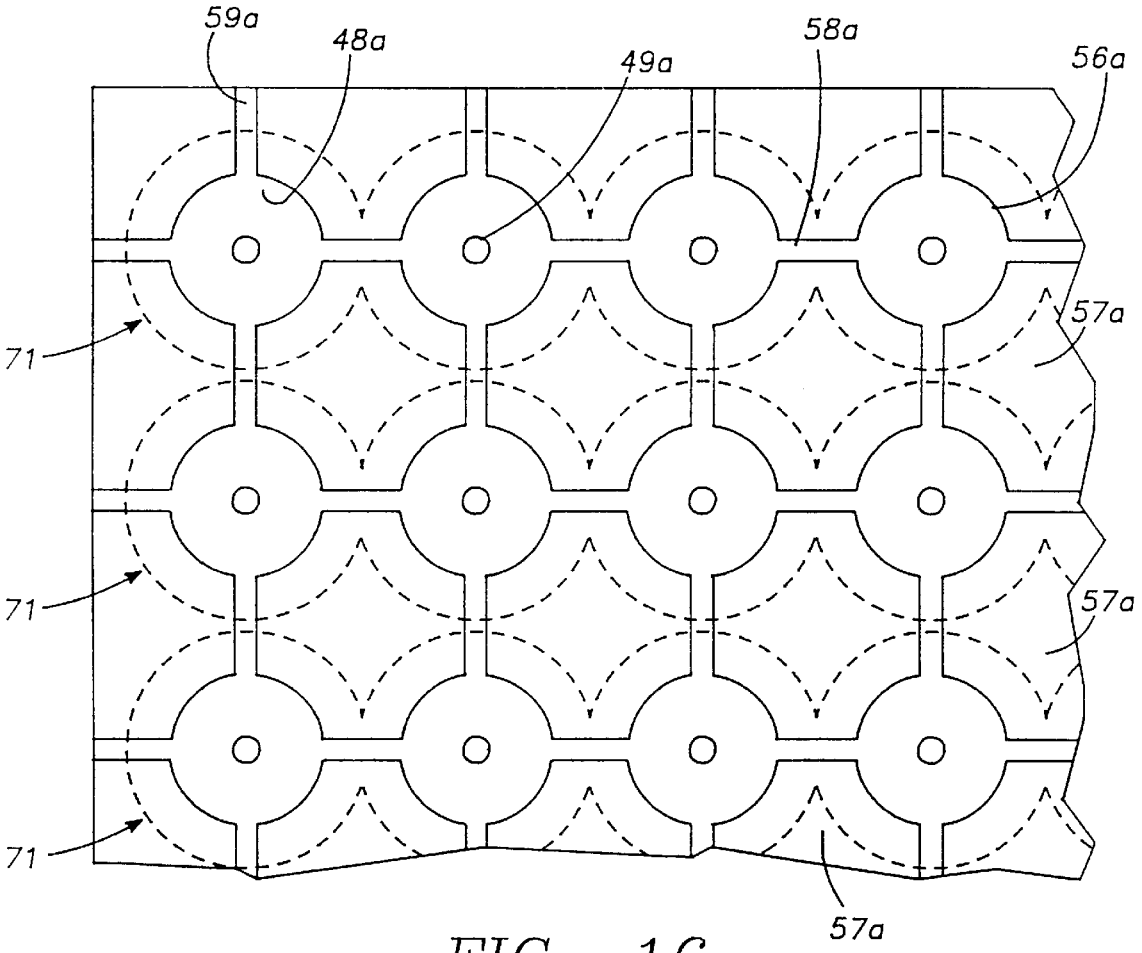
FIG. 16 shows another embodiment of a matrix fluid drop ejector.

The invention has been described in connection with the ejection of a single fluid as, for example, for printing a single color or delivering a single biological material or chemical. It is apparent that ejectors can be formed for ejecting two or more fluids for color printing and chemical or biological reactions. The spacing of the apertures and the size and location of the associated membranes can be selected to provide isolated columns or rows of interconnected reservoirs. Adjacent rows or columns can be provided with different fluids. An example of a matrix of fluid ejectors having isolated rows of fluid reservoirs is shown in FIG. 16. The fluid reservoirs 56*a* are interconnected along rows 71. The rows are isolated from one another by the walls 57*a*. Thus, each of the rows of reservoirs can be supplied with a different fluid. Individual ejectors are energized by applying voltages to the interconnections 58*a* and 59*a*. The illustrated embodiment is formed in the same manner as the embodiment of FIG. 12. It is apparent that spacing of apertures and reservoirs of the embodiment of FIGS. 14 and 15 can be controlled to form isolated rows or columns of reservoirs and apertures to provide for delivery of multiple fluids. The processing of the fluid drop ejector assembly of FIGS. 14 and 15 can be controlled so that there are individual fluid reservoirs with individual isolated membranes.

What is claimed:

1. A fluid drop ejector comprising:

at least one fluid reservoir, at least one elastic membrane having at least one orifice defining at least one nozzle adapted to be in contact with a fluid in said reservoir, a conductive film on the surface of said membrane and a spaced conductor whereby application of the ac electrical signal between the film and spaced conductor generates an electrostatic force which brings said at least one membrane into mechanical oscillation whereby, when the fluid is in contact with said at least one membrane, the displacement of the membrane causes the formation and ejection of a drop of fluid from said at least one nozzle with each cycle of oscillation.

2. A fluid drop ejector which includes:

a substrate, a matrix of elastic membranes, each including at least one aperture, a support structure for supporting the membranes on said substrate and defining at least one fluid reservoir for receiving a fluid, means for supplying fluid to said fluid reservoir, and displacement means responsive to an applied electrical signal for selectively displacing said membranes to cause formation and ejection of drops of fluid from said reservoir.

3. A fluid drop ejector as in claim 2 wherein the means for displacing said membranes comprises piezoelectric transducers affixed to each of said membranes.

4. A fluid drop ejector as in claim 2 wherein the means for displacing said membranes comprises electromagnetic transducers affixed to each of said membranes.

5. A fluid drop ejector as in claim 2 wherein the means for displacing said membranes comprises a conductive film on the surface of each of said membranes and a spaced conductor whereby application of the ac electrical signal between the film and spaced conductor generates an electrostatic force which deflects said membranes.

6. A fluid drop ejector as in claim 2 wherein said support structure defines a plurality of fluid reservoirs whereby each reservoir can receive a different fluid.

7. A fluid drop ejector comprising:

at least one fluid reservoir, a plurality of elastic membranes each having at least one orifice defining at least one nozzle adapted to be in contact with the fluid in said reservoir, displacement means mounted on each of said membranes, each responsive to an applied electrical signal for displacing the corresponding membrane to bring said membrane into mechanical oscillation whereby, when the fluid is in contact with said membrane, the displacement of the membrane causes the formation and ejection of a drop of fluid from said at least one nozzle with each cycle of oscillation.

8. A fluid drop ejector as in claim 7 wherein said at least one fluid reservoir comprises at least two adjacent fluid reservoirs and said at least one elastic membrane includes at least one membrane in contact with fluid in each of said reservoirs, whereby fluids can be selectively ejected from each said reservoir.

9. A fluid drop ejector as in claim 8 wherein said fluid reservoirs are elongated, and a plurality of membranes are in line along each of said reservoirs.

10. A fluid drop ejector as in claim 7 wherein said ejector includes a plurality of elastic membranes arranged in a matrix.

* * * * *